United States Patent [19]

Noddin

[11] 4,254,419

[45] Mar. 3, 1981

[54] MOBILE ANTENNA RAISING AND LOWERING DEVICE

[75] Inventor: Kenneth W. Noddin, Wenonah, N.J.

[73] Assignee: William R. Shockley, Mantua, N.J.

[21] Appl. No.: 55,186

[22] Filed: Jul. 6, 1979

[51] Int. Cl.[3] ..... H01Q 1/32

[52] U.S. Cl. ..... 343/715; 343/882

[58] Field of Search ..... 343/882, 711-715, 343/709

[56] References Cited

U.S. PATENT DOCUMENTS

| | | | |
|---|---|---|---|
| 3,224,003 | 12/1965 | Hummel | 343/709 |
| 3,873,985 | 3/1975 | Altmayer | 343/714 |
| 4,101,897 | 7/1978 | Morrison | 343/882 |

*Primary Examiner*—David K. Moore

*Attorney, Agent, or Firm*—Duffield & Lehrer

[57] ABSTRACT

A mobile two-way communication antenna is mounted on a metal plate which is pivotally secured to a housing so as to pivot about a horizontal axis. An electric reversible motor drives an elongated screw which in turn moves a cam surface linearly. The cam surface coacts with the metal mounting plate for moving the plate and the antenna between a horizontal and a vertical position. Horizontally extending ground plane elements are provided in applications where the housing is nonconducting. These elements contact the metal mounting plate when the plate is in its full upright horizontal position.

9 Claims, 4 Drawing Figures

MOBILE ANTENNA RAISING AND LOWERING DEVICE

BACKGROUND OF THE INVENTION

The present invention is directed toward an antenna raising and lowering device and more particularly toward a device which is intended to be mounted on top of an emergency vehicle for remotely raising and lowering the two-way communication antenna thereof.

As a result of the additional equipment being added to emergency vehicles such as ambulances, fire engines, rescue squads and the like, the more modern vehicles are being made larger than older vehicles. This has created a serious problem with respect to two-way communication antennas which extend upwardly from the top of the vehicle. The problem results from the fact that while the vehicles are becoming larger, they continue to be garaged in existing firehouses and garages with existing door openings which, in many cases, have a height designed for the older and smaller vehicles. With only a small clearance between the top of the vehicle and the garage openings, antennas are frequently broken. This not only adds a significant expense but can seriously interrupt emergency aid while the two-way communication system is being repaired.

Numerous attempts have been made to provide a remotely controlled mobile antenna raising and lowering device. Most of these prior art devices, however, require substantial modifications to the vehicle in order to connect the device to the same. Other prior devices known to Applicant are intended to be mounted within the vehicle and therefore take up substantial space which could be put to other use.

U.S. Pat. No. 4,101,897 describes a collapsible mobile antenna system which is intended to be mounted on top of a vehicle. The system shown in this patent, however, is not motor driven but must be manually operated from outside the vehicle. Accordingly, this system could not be used while the vehicle is in motion.

The antenna raising and lowering device shown in U.S. Pat. No. 3,224,003 is motor driven. However, there is a direct interconnection between the motor and the antenna. As a result, if the antenna is in the down position and a defect in the motor system occurs, the antenna cannot be raised, thereby rendering the communication system inoperative. Furthermore, movement of the antenna is directly proportional to rotation of the motor which can result in very slow operation of the antenna.

In addition to all of the foregoing defects of the prior art known to applicant, applicant is not aware of any prior antenna raising and lowering devices which include a means for providing a ground plane for the antenna. Such a ground plane is very often necessary when the structure on which the antenna raising and lowering device is mounted does not provide an adequate natural ground plane.

SUMMARY OF THE INVENTION

The present invention overcomes all of the defects of the prior art described above by providing a mobile two-way communication antenna which is mounted on a metal plate pivotally secured to a housing so as to pivot about a horizontal axis. An electric reversible motor drives an elongated screw which in turn moves a cam surface linearly. The cam surface coacts with the metal mounting plate for moving the plate and the antenna between a horizontal and a vertical position. Horizontally extending ground plane elements are provided in applications where the housing is nonconducting. These elements contact the metal mounting plate when the plate is in its full upright horizontal position.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
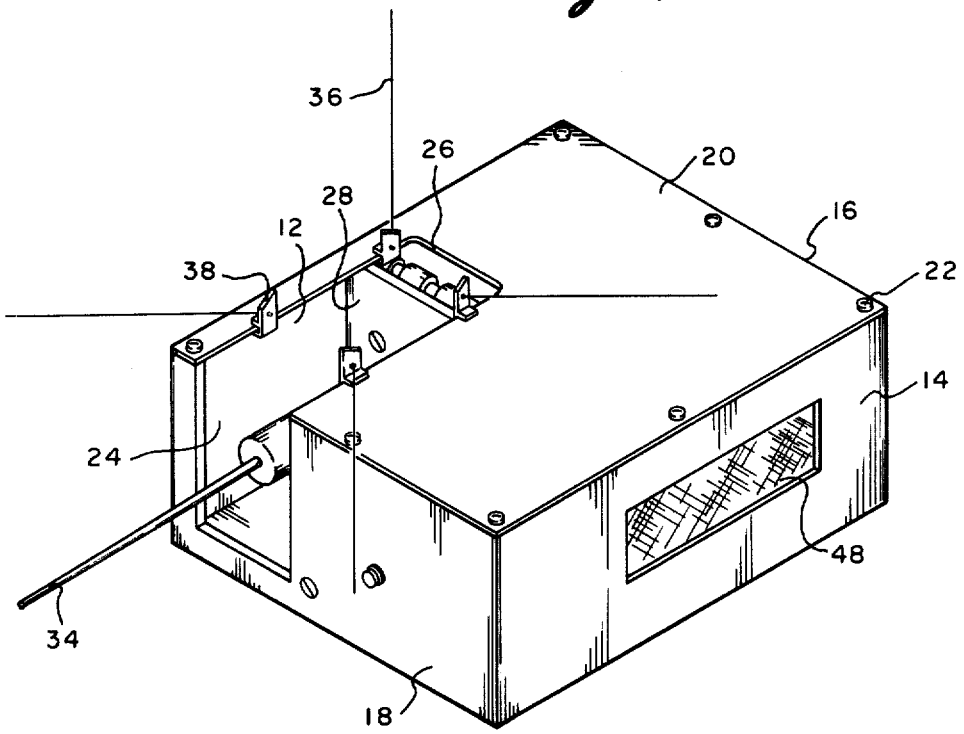
FIG. 1 is a perspective view of the antenna raising and lowering device of the present invention with the antenna shown in its lowered position.

Referring now to the drawings in detail wherein like reference numerals have been used throughout the various figures to designate like elements, there is shown in FIG. 1 an antenna raising and lowering device constructed in accordance with the principles of the present invention and designated generally as 10. Antenna raising and lowering device 10 is comprised of a substantially box-shaped housing including upstanding side walls 12 and 14, real wall 16 and front wall 18. A cover member 20 is secured to the upstanding walls by way of a plurality of screws 22.

Both front wall 18 and the cover 20 have a substantially rectangularly-shaped cutout portion therein as shown at 24 and 26, respectively. Each of the cutout portions are formed adjacent the corner of the housing and in line with each other so that the housing is open at the front and top thereof as is clearly shown in FIG. 1.

Figure 2:
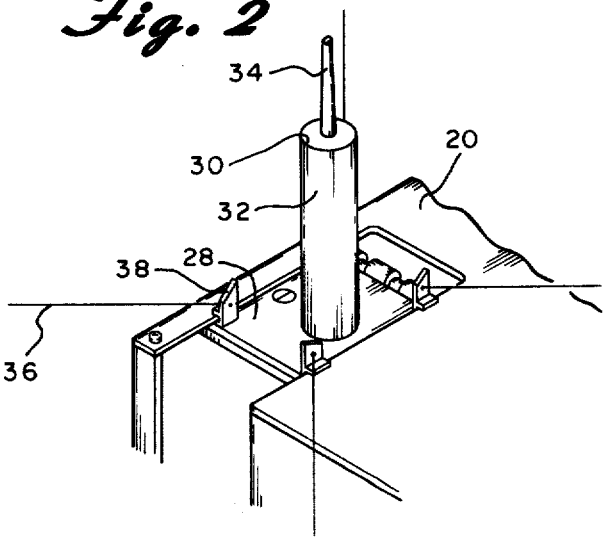
FIG. 2 is a perspective view of a portion of the device shown in FIG. 1 showing the antenna in its raised position.

Mounted within this opening in the housing in a manner to be more clearly described hereinafter is a metal antenna mounting plate 28. Plate 28 is mounted so as to be pivotable between a first position wherein the same is substantially vertically oriented (FIG. 1) to a second position wherein the plate 28 is substantially horizontal (FIG. 2). Secured to the central part of mounting plate 28 is a two-way communication antenna 30. Antenna 30 is shown to be of the bottom loading type including a loading coil 32 and a whip element 34 extending therefrom. It should be understood, however, that this is by way of example only and that the present device may be used for raising and lowering numerous other types of antennas.

As is well known in the art, two-way mobile communication antennas normally need a ground plane for proper operation. Normally if the antenna is mounted directly on the top of a vehicle, the vehicle itself functions as the ground plane. However, if the antenna is mounted a distance above the top of the vehicle, the ground plane effect of the vehicle itself is lost. With respect to the present invention, if the housing is comprised of metal and the same is mounted directly on the top of a vehicle, the housing and vehicle, in most cases, would function as a ground plane. There may, however, be instances when the ground plane effect from the vehicle would not be present. This would be particularly true if the housing of the present invention were constructed from a nonconductive material.

In order to ensure an adequate ground plane, the present invention includes ground plane elements. These are comprised of a plurality of elongated rigid wire or tubular members 36 which are arranged around the opening 26 in the cover member 20 and are oriented so as to extend outwardly from the opening 26 parallel to the cover 20. Ground plane elements 36 are secured to the cover 20 by way of metallic clips 38. The lowermost part of the clips 38 extend downwardly into the interior of the housing. As shown most clearly in FIG. 2, when the plate 28 is pivotted into its uppermost horizontal position, i.e. when the antenna 30 is in its operative mode, the upper surface of plate 28 contacts the clips 38 thereby completing the electrical circuit between the ground plane elements 36 and the plate 28 for effecting a proper ground plane. As should be readily apparent to those skilled in the art, the length, diameter and number of ground plane elements 36 will be selected so as to be compatible with the particular antenna 30 and so as to provide a proper ground plane.

Figure 3:
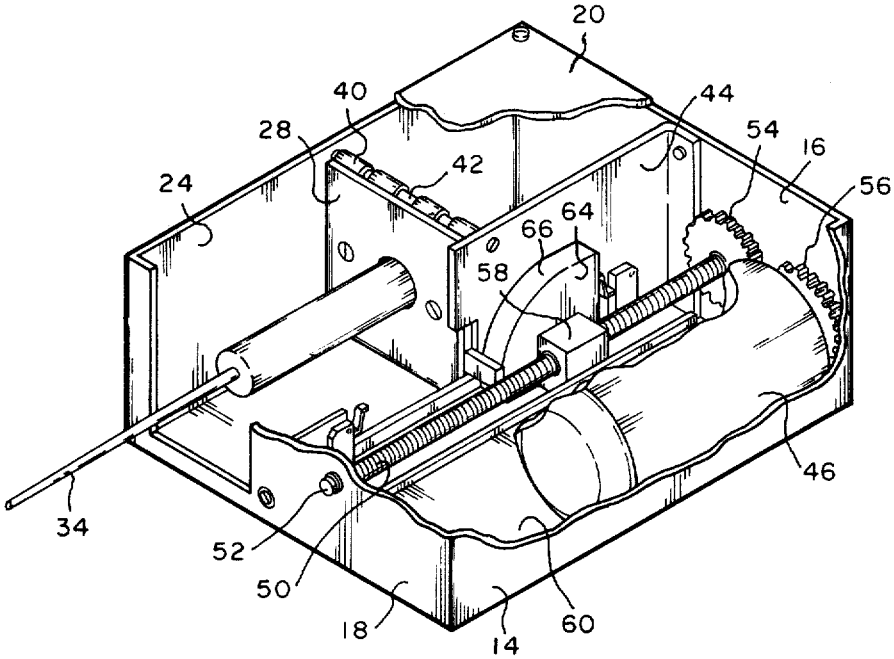
FIG. 3 is a perspective view similar to FIG. 1 but with portions broken away to illustrate the internal operation of the device.
Figure 4:
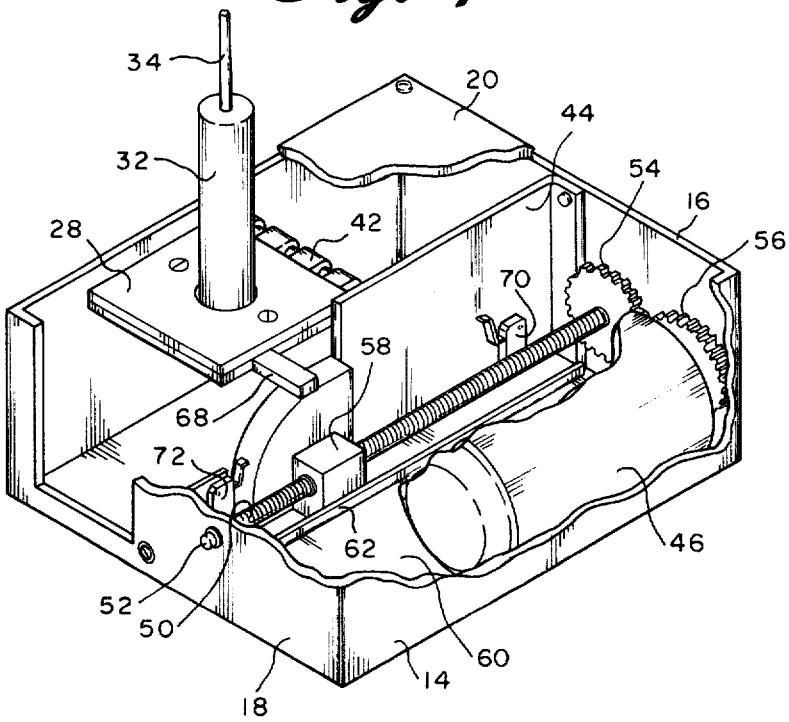
FIG. 4 is a perspective view similar to FIG. 3 showing the antenna in the raised position.

The mechanism for moving the plate 28 from its inoperative vertical position to its operative horizontal position is most clearly shown in FIGS. 3 and 4. It can there be seen that plate 28 is connected to hinge element 40 which, in turn, is pivotally associated with rod 42 which extends between left side wall 24 and intermediate wall 44. Intermediate wall 44 is a partial wall which separates the housing into two basic compartments: the antenna compartment and the motor mechanism compartment.

Mounted in the housing in the motor mechanism compartment is a reversible electric motor 46. As shown in FIG. 1, a grill 48 may be provided in the side wall 14 adjacent the motor 46 for cooling purposes. Mounted adjacent the motor 46 and extending lengthwise of the housing between front wall 18 and rear wall 16 is an elongated screw 50. Screw 50 is mounted to the walls 16 and 18 by way of bearings 52 or the like so as to allow free rotational movement of the screw. Securely attached to the end of the screw 50 is a gear 54 which is engaged by gear 56 attached to the drive shaft of motor 46. Screw 50 is thereby caused to rotate in a clockwise or counterclockwise direction depending on the selected rotational direction of motor 46.

A substantially rectangularly-shaped block 58 has a bore there through in which is formed an internal screw thread complementary to the screw 50. Block 58 is threaded onto the screw 50 with the bottom surface of block 58 in close proximity to the bottom wall 60 of the housing. Adjacent the block 58 on the side near the motor 46 is an upstanding guide rail 62 secured to the bottom wall 60. Guide rail 62 and the bottom wall 60, being in close proximity to the block 58, prevent rotational movement of the block and guide the same longitudinally. It should be readily apparent that as a result of the threaded engagement between screw 50 and block 58, block 58 moves linearly forwardly or backwardly depending on the direction of rotation of screw 50.

Securely attached to the block 58 and on the side thereof remote from motor 46 and adjacent intermediate wall 44 is a second block 64. The forward edge of block 64 has a cam surface 66 formed thereon. In the embodiment shown, the cam surface 66 is continuous and convex arcuately formed. Block 64, being secured to block 58, moves linearly as block 58 is moved linearly. Intermediate wall 44 being in close proximity to block 64 also functions as a guide for the block.

Secured to the outer edge of the plate 28 and at a position remote from the hinge 40 is a tab 68. Tab 68 extends from the plate 28 through the opening in the intermediate wall 44 and into the motor mechanism compartment. The free end of tab 68 lies in front of and is engageable with the cam surface 66.

FIG. 3 shows the antenna raising and lowering device 10 of the present invention with the antenna 30 in its inoperative position and with plate 28 substantially vertically oriented. It can there be seen that block 64 is in its rearwardlymost position and tab 68 engages the lowermost portion of cam 66. When the motor is energized, screw 50 rotates and block 58 moves linearly forwardly carrying with it block 64 and cam 66. Tab 68, therefore, functions as a cam follower and moves upwardly staying in contact with the surface of cam 66. Upward movement of tab 68 also causes upward or rotational movement of plate 28. This movement of block 64, tab 68 and plate 28 continues until the antenna is in its raised position as shown in FIG. 4.

As shown most clearly in FIGS. 3 and 4, limit switches 70 and 72 are positioned at the remote ends of screw 50 and function to interrupt the electrical circuit to the motor 46 when the antenna is in its full operative or full inoperative position. The complete electrical system for controlling operation of motor 46 should be readily apparent to those skilled in the art and accordingly it is not believed that a detailed description is necessary. An example of such a system is shown in U.S. Pat. No. 3,224,003. However, any equivalent system could also be used.

The advantages of the present antenna raising and lowering device 10 over the prior art are manifold. In addition to the ground plane feature described above, the antenna 30 of the present invention can be raised manually in the event that a defect occurs in the motor, electrical system or gears. In other words, if the antenna is in the down position shown in FIGS. 1 and 3 and the motor fails to operate to move the cam surface 66 for raising the antenna, all that is necessary is to manually lift the antenna and plate 28 and temporarily rest some support beneath plate 28 for maintaining the same at its upwardly position. Furthermore, although the linear movement of blocks 58 and 64 may be constant with constant rotation of screw 50, the speed of upward movement of plate 28 can be varied, if desired, by changing the shape of the cam surface 66.

The present invention may be embodied in other specific forms without departing from the spirit or essential attributes thereof and, accordingly, reference should be made to the appended claims rather than to the foregoing specification as indicating the scope of the invention.

I claim:

1. An antenna raising and lowering device comprising:

a housing;

a substantially planar antenna mounting plate means pivotally secured to said housing and being adapted to be pivotted about a substantially horizontal axis between an inoperative position wherein said plate means is substantially vertically disposed within said housing and an operative position wherein said plate means is substantially horizontally disposed and further being adapted to support an antenna thereon;

a cam surface within said housing, said cam surface being adapted to engage part of said plate means for moving the same between said operative and said inoperative positions; elongated screw means and motor means for rotating said screw means for moving said cam surface.

2. The device as claimed in claim 1 wherein said cam surface is adapted to move linearly.

3. The device as claimed in claim 1 wherein said motor means includes an electric motor.

4. The device as claimed in claim 1 further including a block having a threaded bore therein and being threaded onto said screw, said block carrying said cam surface.

5. The device as claimed in claim 4 wherein said plate means includes a tab means extending therefrom, said cam surface being adapted to engage said tab.

6. The device as claimed in claim 4 including means for preventing rotational movement of said block.

7. The device as claimed in claim 1 wherein said housing includes a cover member including an opening therein.

8. The device as claimed in claim 7 wherein said plate means underlies said opening when in said operative position.

9. The device as claimed in claim 8 including a plurality of elongated ground plane elements mounted on said housing and extending outwardly therefrom, said plate means being in electrical contact with said ground plane elements when in said operative position.

* * * * *